US011931646B2

(12) United States Patent
Burgon

(10) Patent No.: US 11,931,646 B2
(45) Date of Patent: Mar. 19, 2024

(54) MODULE FOR THE CONSTRUCTION OF A RECREATIONAL TRACK, PARTICULARLY A BICYCLE TRACK

(71) Applicant: PARKITECT s.r.o., Valasska Polanka (CZ)

(72) Inventor: Erik Burgon, Speicher (CH)

(73) Assignee: PARKITECT s.r.o., Valasska Polanka (CZ)

( * ) Notice: Subject to any disclaimer, the term of this patent is extended or adjusted under 35 U.S.C. 154(b) by 0 days.

(21) Appl. No.: 18/010,397

(22) PCT Filed: Jun. 18, 2021

(86) PCT No.: PCT/CZ2021/000030
§ 371 (c)(1),
(2) Date: Dec. 14, 2022

(87) PCT Pub. No.: WO2021/254543
PCT Pub. Date: Dec. 23, 2021

(65) Prior Publication Data

US 2023/0181998 A1 Jun. 15, 2023

(30) Foreign Application Priority Data

Jun. 18, 2020 (PL) ..... 129301

(51) Int. Cl.
*A63C 19/10* (2006.01)

(52) U.S. Cl.
CPC ..... *A63C 19/10* (2013.01); *A63C 2203/10* (2013.01)

(58) Field of Classification Search
CPC ..... A63C 19/00; A63C 19/10; A63K 1/00; A63K 1/02; A63G 21/60; E01D 1/00
(Continued)

(56) References Cited

U.S. PATENT DOCUMENTS 5,946,756 A * 9/1999 Mapp ..... A63C 19/10 472/90
2003/0125120 A1* 7/2003 Montolio ..... A63C 19/10 472/89

(Continued)

FOREIGN PATENT DOCUMENTS

DE 29714693 U1 12/1997
DE 202017102202 U1 5/2017

(Continued)

OTHER PUBLICATIONS

International Search Report issued by the European Patent Office for International Patent Application No. PCT/CZ2021/000030, dated Oct. 15, 2021.

(Continued)

*Primary Examiner* — Kien T Nguyen
(74) *Attorney, Agent, or Firm* — Myers Wolin, LLC

(57) ABSTRACT

A module for the construction of a recreational track, particularly a bicycle track having a frame on which the modules are placed, wherein the module has an upper part intended for riding and making a curved surface, and in the top view it has a quadri-lateral-like shape with two sides in the shape of arches, a rear wall and a front wall, wherein the rear wall and the front wall form the base of the module, as well as the left face wall and the opposite right face wall, which are placed between the rear wall and the front wall, characterized in that in the side view, the rear wall has the quadrilateral shape, the sides of which converge upwards at an acute angle, and in the side view the front wall has the shape of an arc connecting the upper part with the base of the module.

6 Claims, 6 Drawing Sheets

(58) Field of Classification Search
USPC ..... 472/85, 88, 89
See application file for complete search history.

(56) References Cited

U.S. PATENT DOCUMENTS

| | | | | |
|---|---|---|---|---|
| 2003/0176226 | A1* | 9/2003 | Kelsey | A63C 19/10 472/89 |
| 2016/0090699 | A1* | 3/2016 | McIntosh | E01C 5/005 472/89 |

FOREIGN PATENT DOCUMENTS

| | | | |
|---|---|---|---|
| EP | 0378725 | A1 | 7/1990 |
| EP | 0796641 | A1 | 9/1997 |
| EP | 0870523 | A2 | 10/1998 |
| FR | 2757075 | A1 | 6/1998 |

OTHER PUBLICATIONS

Winterthur Sportamt et al. "Mobiler Pumptrack", Jun. 3, 2018, pp. 1-25, Retrieved from the Internet: URL:https://docplayer.org/165968643-Handbuch-pumptrack-on-tour-bikeparkitect-modular-pumptrack-ausfuehrung-holz-composite.html on Oct. 4, 2021, with English Abstract.

Parkitect: "Parkitect AG Reutenenstrasse 22 9042 Speicher Switzerland Montage Anleitung" , Feb. 26, 2018, Retrieved from the Internet: URL: https//sh.ch/CMS/get/file/9f5c5c9e-2332-4c90-af98-cffcef633bba on Oct. 4, 2021, with English Abstract.

* cited by examiner

MODULE FOR THE CONSTRUCTION OF A RECREATIONAL TRACK, PARTICULARLY A BICYCLE TRACK

CROSS REFERENCE TO RELATED APPLICATIONS

The present application is a U.S. National Phase under 35 U.S.C. 371 of International Patent Application Serial No. PCT/CZ2021/000030, filed on Jun. 18, 2021, which claims priority to Polish Application W. 129301, filed on Jun. 18, 2020, the contents of each of which are incorporated by reference in their entirety for all purposes.

FIELD OF THE INVENTION

The subject of this utility model is a module for the construction of a recreational track, particularly a bicycle track.

BACKGROUND

Recreational tracks, which are intended particularly for cycling, but also for roller skating, are known under the name pump-track and are a purposefully prepared small track, which enables riding on a two-wheeled device (usually a bicycle) and provides comprehensive training. It is made of high-speed curves and moguls. It develops users' reflexes, a sense of balance and fitness.

From the French application document FR2757075, a modular skating track is known. The track is made of a horizontal surface connected to modular curved sections. The upper part of the end section is covered by a cylindrically-shaped bumper. The slope is connected to the platform by a safety barrier. The curved surfaces are supported on a frame made of vertical, horizontal and diagonal bars. They are stiffened with triangular bars and connected to each other by mounting plates. The horizontal surface is supported by bars beneath it, and inclination can be varied with means of feet of variable height.

From the European application document EP0378725A1 a track solution is known, in particular for a skateboard, made of individual modules. In order to set up a skateboard track which can be constructed outdoors and which has a long service life with simultaneously excellent rolling properties, it is proposed to construct a skateboard track from individual modules that consist of precast concrete, thus they have excellent riding properties on their running side and at the same time generate less noise than previously known tracks.

From the European application document EP0870523A1, a roller track solution made of individual elements is known. The track structure consists of many sections that form a hollow track with flat bottom and a number of end sections, with which the structure has a closed semicircular end. The hollow track consists of concave sections that have flat horizontal platforms along the hill. Platforms are used for starting or landing. Users can also move along the structure and along the semicircular end. The concave sections are supported by struts. A roof can be added to the structure.

From the European application description EP0796641A1, a roller track solution made of individual modules is known. A roller track comprises at least one portion with a bent surface, wherein this portion consists of a bent surface which is primarily supported by curved slats extending primarily in the direction of curvature of the bent plate.

Known tracks can be made of wood, concrete or plastic, wherein concrete can be poured on the construction site of the track, for example, or it can be made in the form of modular elements manufactured externally to the construction site and appropriately selected according to the needs, particularly the shape of the terrain or the need to ensure proper track construction.

Recreational tracks known from the state of the art, particularly tracks made of concrete elements, are characterized by high weight, which causes great difficulties in their construction and also affects their cost. It is also important that known tracks, due to their geometry, do not provide the optimal level of user safety.

SUMMARY

The purpose of the utility model is to provide modular elements for the construction of a recreational track, particularly a bicycle track, which in addition to low construction costs for the track, ensure optimal riding trajectory for the user, thus contributing to the ergonomics and safety of riding as well as enabling the construction of tracks of various shapes.

A module for the construction of a recreational track, particularly a bicycle track, according to the utility model, relates to the construction of a track having a frame on which modules are placed.

The module has the upper part intended for riding that makes a curved surface. In the top view, the module has a quadrilateral-like shape with two sides in the shape of arcs and two straight sides. The module has a rear wall and a front wall, wherein the rear wall and the front wall form the base of the module, as well as a left face wall and an opposite right face wall, which are placed between the rear wall and the front wall. The module is characterized in that, in the side view, the rear wall has a quadrilateral shape, the sides of which converge upwards at an acute angle, and the front wall in the side view has the shape of an arc connecting the upper part with the base of the module, wherein the left face wall and the right face wall form an acute angle in the top view, and when viewed from the side of the left face wall, the curved surface making the upper part of the module is concave towards the base formed by the rear wall and the front wall.

Preferably, when viewed from the left face wall, the upper part intended for riding, in the direction from the front wall towards the rear wall, forms a straight line section and then a concave arc to the base of the module extending to the rear wall.

It is also advantageous, when the rear wall of the module consists of an upper rear wall and a bottom rear wall.

It is also advantageous, when the rear wall is inclined at an acute angle with respect to the vertical direction.

It is also advantageous, when the edge of the top portion adjacent to the rear side wall has a radius in the range from 50 mm to 100 mm.

It is also advantageous, when the upper part of the module intended for riding has a roughened surface.

BRIEF DESCRIPTION OF THE DRAWINGS

The utility model is presented in the attached drawing, in which.

3 shows the module for the construction of a recreational track, particularly a bicycle track, from the front wall side, in a straight view.

DETAILED DESCRIPTION OF THE PREFERRED EMBODIMENTS

Module 1 is used to construct a recreational track, particularly a bicycle track, which has the frame on which modules are placed.

Figure 4:
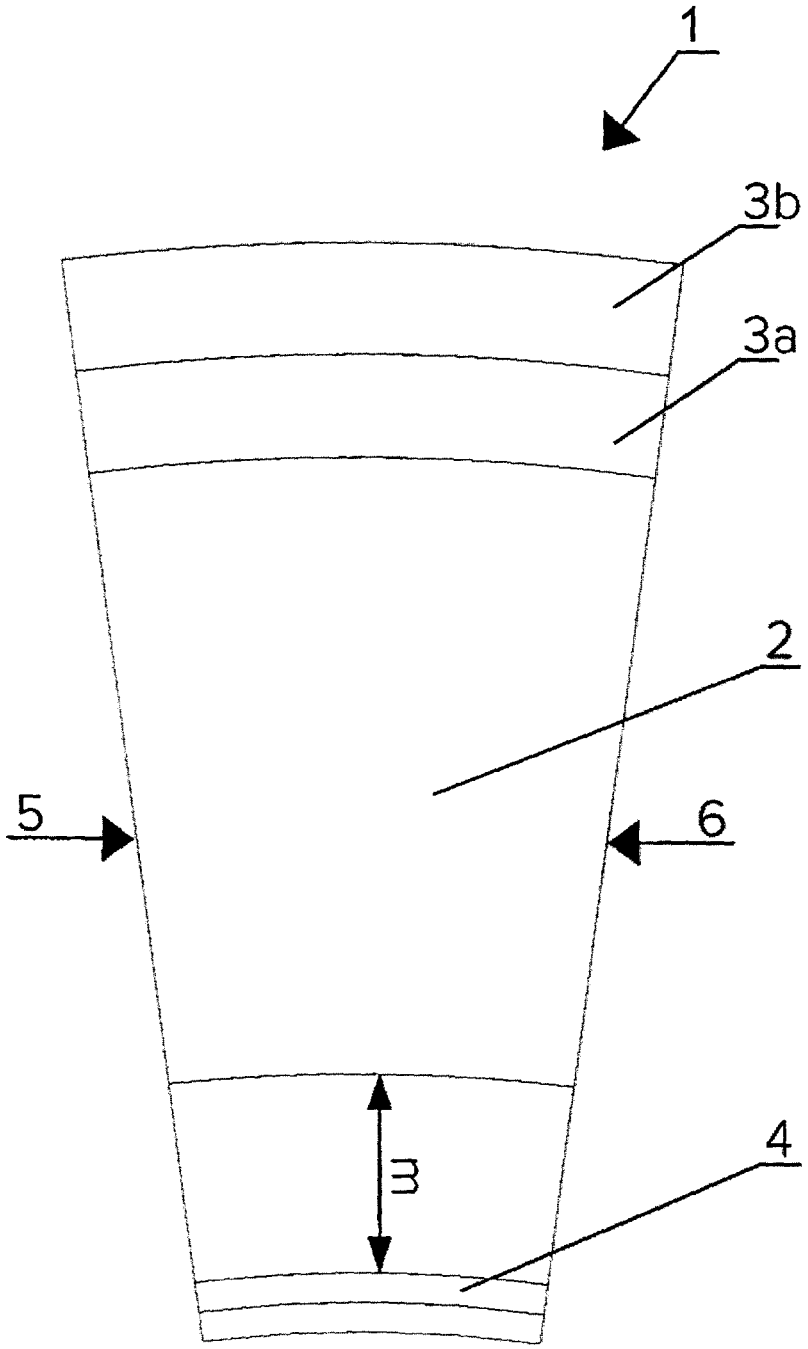
FIG. 4 shows the module for the construction of a recreational track, particularly a bicycle track, in top view.

As shown in FIG. 1 and FIG. 2 and FIG. 3 and FIG. 4, the module 1 has an upper part 2 intended for riding, making a curved surface. In the top view, the module 1 has a quadrilateral-like shape with two sides in the shape of arc, as it is shown in FIG. 4. The module 1 has a rear wall 3 and a front wall 4, and a left face wall 5 and an opposite right face wall 6, which are placed between the rear wall 3 and the front wall 4. The rear wall 3 and the front wall 4 form the base of the module 1.

Figure 5:
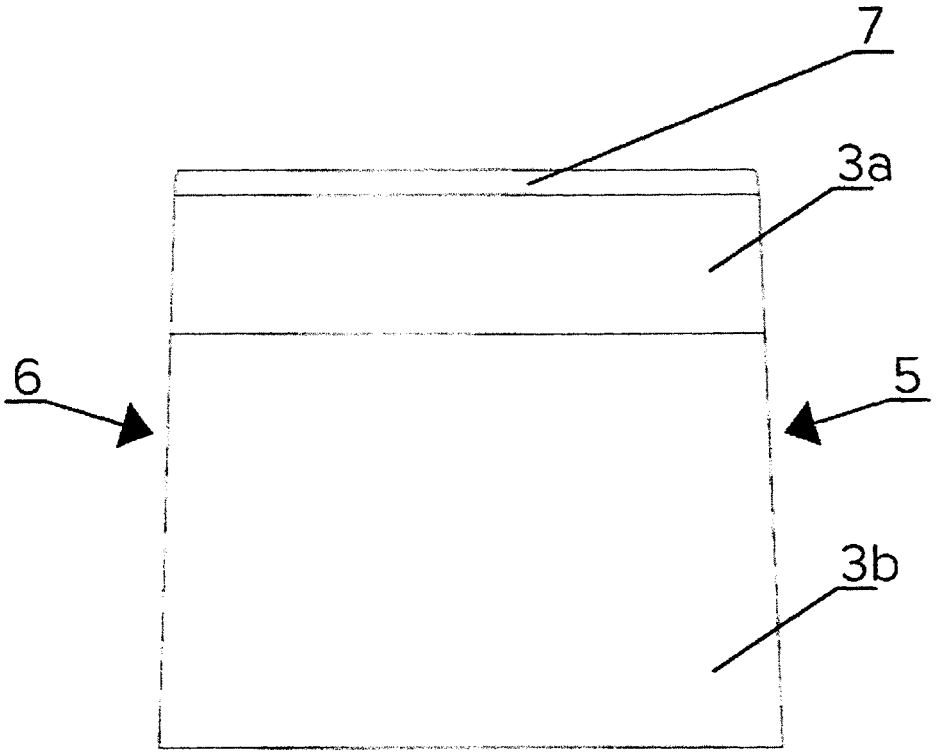
FIG. 5 shows the module for the construction of a recreational track, particularly a bicycle track, in a straight view from the rear wall side.
Figure 6:
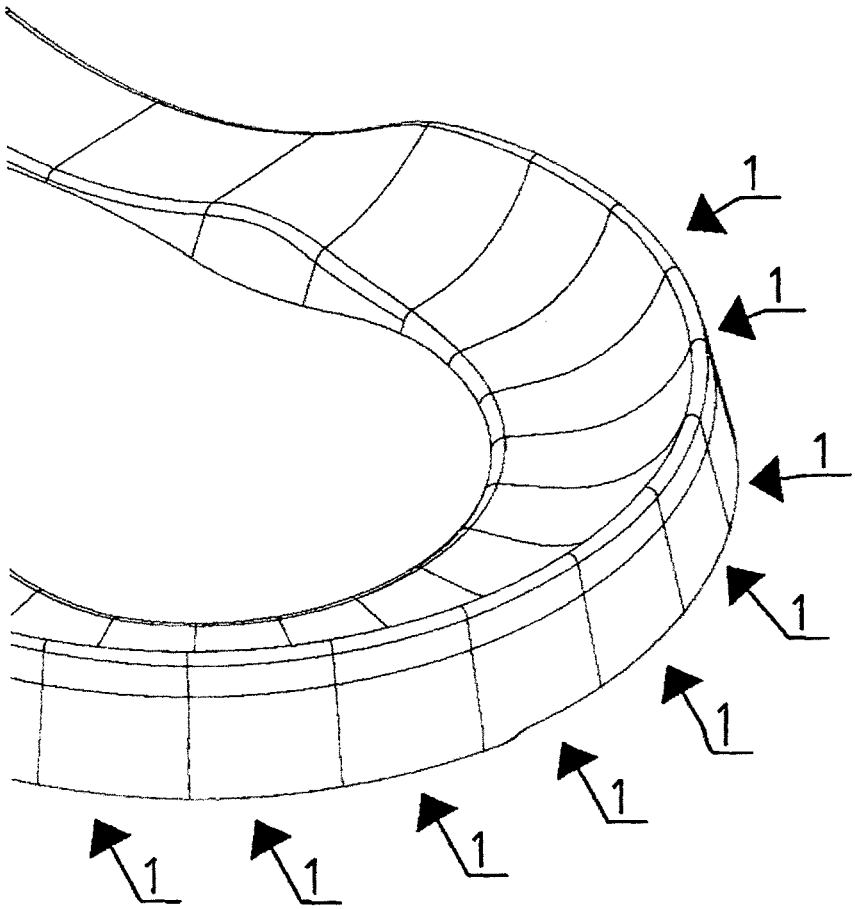
FIG. 6 shows the location of the module for the construction of a recreational track, particularly a bicycle track, in the exemplary recreational track.

As shown in FIG. 5, in a side view, the rear wall 3 has a quadrilateral shape, the sides of which converge upwards at an acute angle. The rear wall 3 of the module 1 consists of an upper rear wall 3*a* and a bottom rear wall 3*b*.

Figure 2:
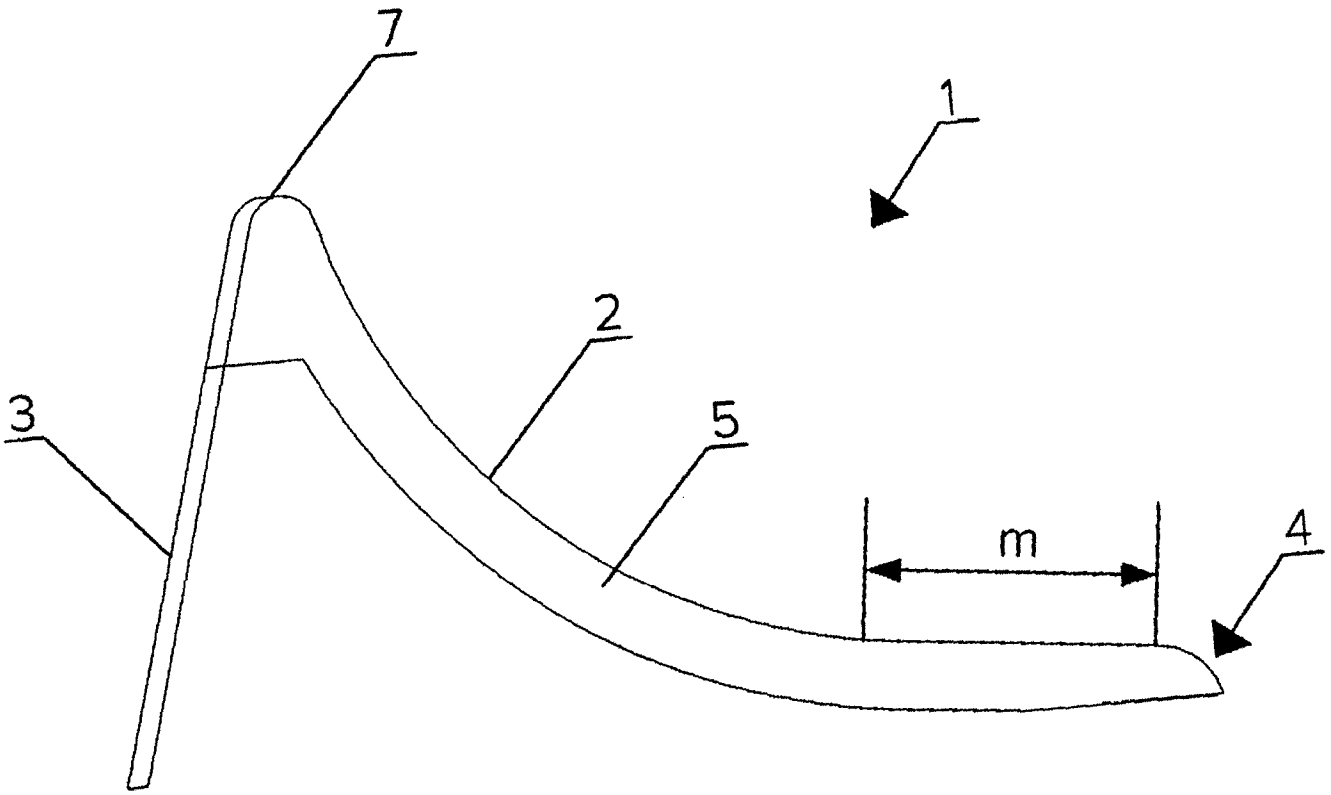
FIG. 2 shows the module for the construction of a recreational track, particularly a bicycle track, in a view from the left face wall, FIG.
Figure 3:
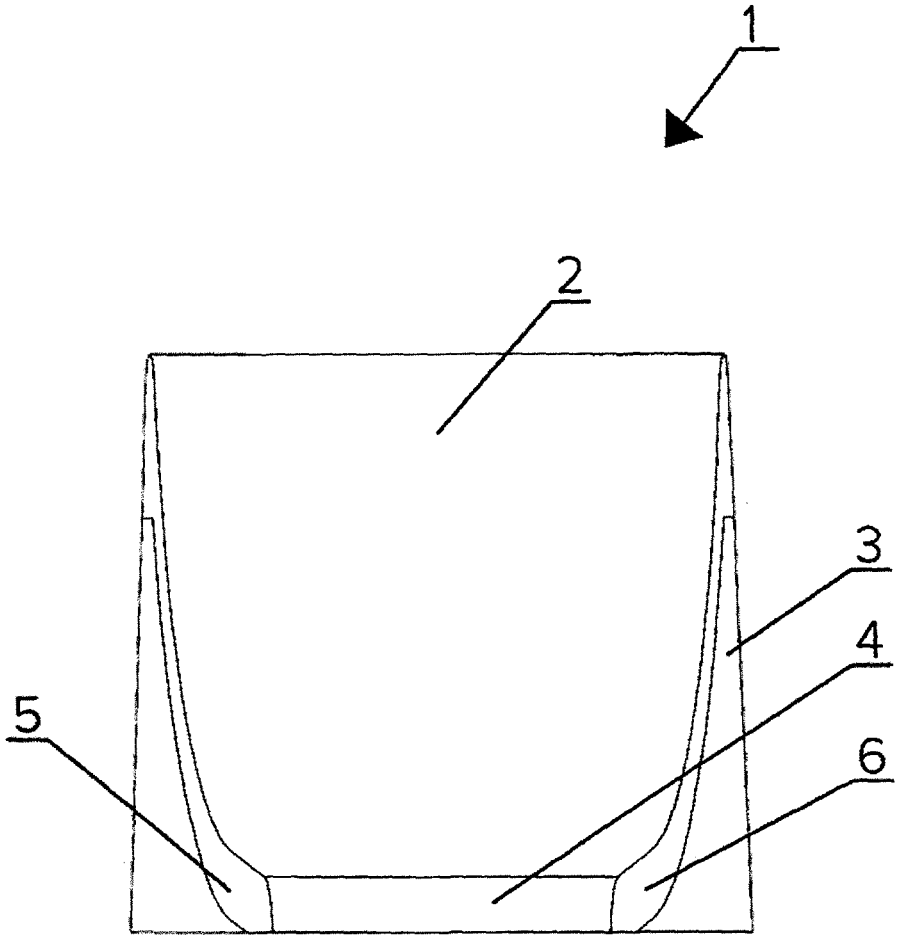

As shown in FIG. 2, in the view from the left face wall 5, the curved surface making the upper part 2 of the module 1 is concave towards the base formed by the rear wall 3 and the front wall 4. The front wall 4 has the shape of the arc connecting the upper part 2 with the base of the module 1, and the rear wall 3 is inclined at an acute angle with respect to vertical direction. The upper part 2 intended for riding, in direction from the front wall 4 towards the rear wall 3, makes the m straight section and then a concave turn to the base of the module 1 extending to the rear wall 3. Inclination in the plane transversal to the rear wall 3 causes a type of "pulling" of a person riding on the track towards the centre of the axis of travel direction of the module 1. While riding very slowly, the person using the track moves along the flat section m of the module 1 from the front wall 4 side.

As shown in FIG. 4, the left face wall 5 and the right face wall 6 form an acute angle in the top view. The terms "right" and "left" have conventional meanings, as the module 1 is symmetrical with respect to its transverse axis.

Figure 1:
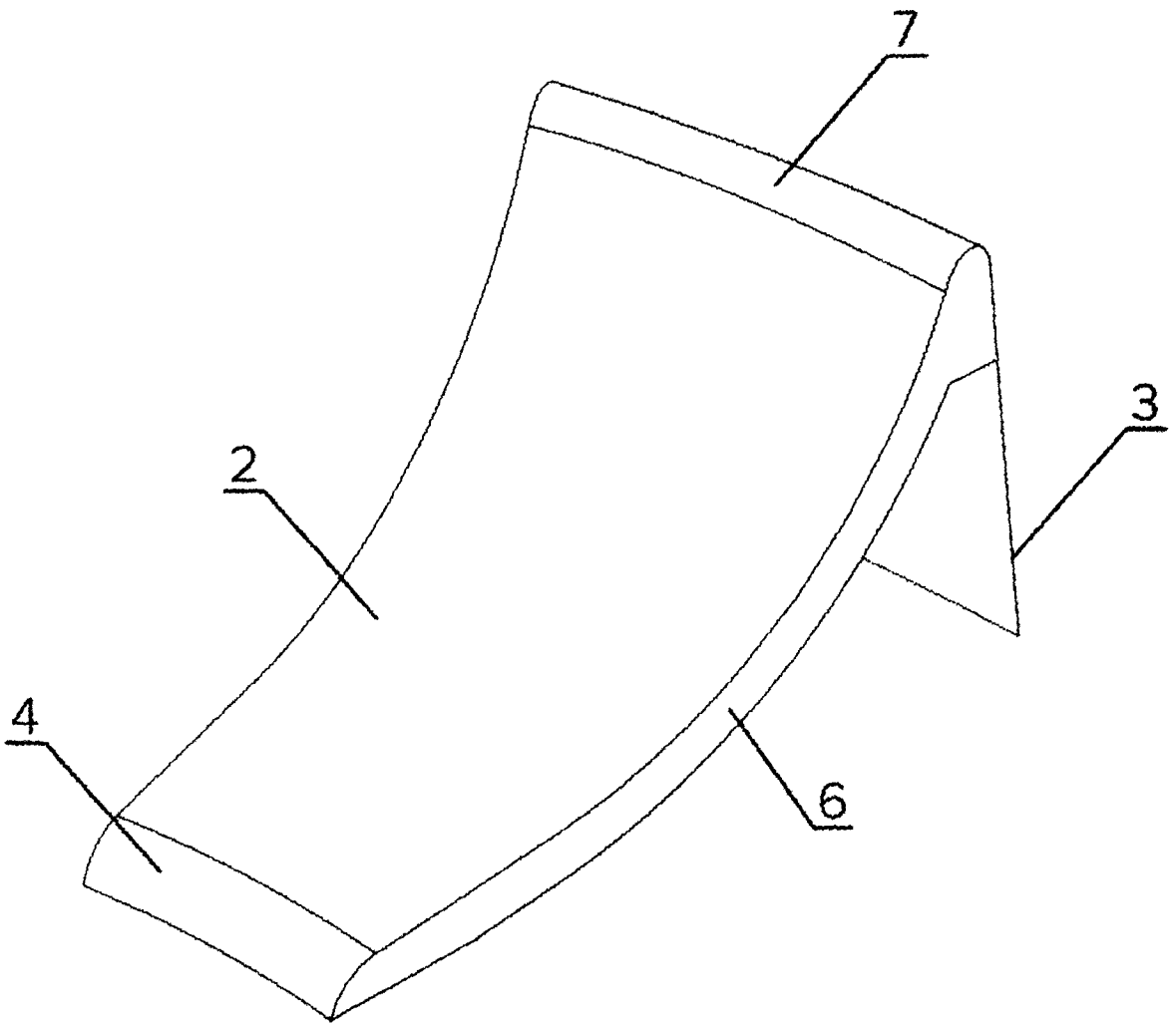
FIG. 1 shows a module for the construction of a recreational track, particularly a bicycle track, from the side of the riding surface, in a perspective view.

As shown in FIG. 1 and FIG. 2 and FIG. 5, the edge of the top part 2 adjacent to the rear side wall 4 has a curvature 7 with a radius in the range from 50 mm to 100 mm.

The upper part 2 of the module 1, which is intended for riding, has a roughened surface, thus increasing the safety of riding.

Roughness is obtained by covering the module 1 with paint, applying a layer of quartz silica before the paint dries, removing excess silica after the paint dries and applying another layer of paint.

The module 1 for the construction of a recreational track, particularly a bicycle track, is made of plastic with fibreglass base.

The invention claimed is:

1. A module for construction of a recreational track in a form of a bicycle track comprising modules, wherein each of the modules comprises an upper part of the track intended for riding and making a curved surface, wherein the module has a quadrilateral shape with two sides in a shape of arches, a rear wall and a front wall, wherein the rear wall and the front wall form a base of the module as well as a left face wall and an opposite right face wall, which are placed between the rear wall and the front wall, wherein the rear wall has the quadrilateral shape, sides of which converge upwards at an acute angle, wherein the front wall has a shape of an arch connecting the upper part of the track with the base of the module, wherein the left face wall and the right face wall form an acute angle, wherein when viewed from the left face wall the left face wall and the right face wall form a curved surface of the track making the upper part of the module, wherein the curved surface of the track is concave towards a base formed by the rear wall and the front wall, wherein surfaces of a curvature and an end of the rear side wall are round, and wherein the track comprises inclination in the plane transversal to the rear wall.

2. The module according to claim 1, wherein the upper part of the track intended for riding, in direction from the front wall towards the rear wall, makes a straight section (m) of the upper part of the track and then a concave arc of the upper part of the track to the base of the module running to the rear wall, wherein the concave arc is a part of the track located between an end of the straight section (m) and the curvature of the upper part of the track.

3. The module according to claim 1, wherein the rear wall of the module comprises an upper rear wall of the track and a bottom rear wall.

4. The module according to claim 1, wherein the rear wall is inclined at an acute angle with respect to a vertical direction.

5. The module according to claim 1, wherein an edge of the upper part of the track, adjacent to the rear side wall, comprises the curvature with a radius in the range from 50 mm to 100 mm.

6. The module according to claim 1, wherein the upper part of the module, which is intended for riding, has a roughened surface.

* * * * *